United States Patent [19]

Blake, III

[11] 4,344,226

[45] Aug. 17, 1982

[54] DISPOSABLE SAFETY RAZOR

[76] Inventor: Joseph W. Blake, III, R.R. #2, Box 106, Kitchewan Rd., South Salem, N.Y. 10590

[21] Appl. No.: 140,452

[22] Filed: Apr. 17, 1980

[51] Int. Cl.[3] ..... B26B 21/12

[52] U.S. Cl. ..... 30/31; 30/55; 30/77

[58] Field of Search ..... 30/30, 31, 32, 53, 55, 30/64, 77

[56] References Cited

U.S. PATENT DOCUMENTS

| | | | |
|---|---|---|---|
| 993,132 | 5/1911 | Warner | 30/55 |
| 1,359,666 | 11/1920 | Brandt | 30/30 |
| 2,715,268 | 8/1955 | Randol | 30/64 |
| 2,789,346 | 4/1957 | Algier | 30/32 |
| 3,605,265 | 9/1971 | Iten | 30/64 |
| 3,675,322 | 7/1972 | Perry | 30/32 |
| 3,675,323 | 7/1972 | Braginetz | 30/32 |

*Primary Examiner*—Nicholas P. Godici
*Attorney, Agent, or Firm*—Karl H. Gross

[57] ABSTRACT

A disposable razor has a body of synthetic plastic material. The front portion of the body has a slot in which a single-edge blade is mounted. A bladeguard is either a separate element and detachably connected to the body, or is of one piece with the body and can be broken off and removed.

8 Claims, 2 Drawing Figures

DISPOSABLE SAFETY RAZOR

BACKGROUND OF THE INVENTION

This invention relates generally to safety razors, and more particularly to razors of the blade type.

Still more specifically, the invention relates to disposable razors which are especially—but not exclusively—suitable as surgical razors.

Whenever human (or, for that matter, animal) surgery is to be performed at or near parts of the body which exhibit a growth of hair, the hair must be removed prior to surgery. This is done to avoid interference with the execution of surgery and also for hygienic reasons. Electric shavers are not suitable for this purpose, for a variety of reasons known to those conversant with the art. Straight razors can be used, but require extraordinary care in use and are rather expensive to purchase as well as to maintain (they must be sharpened and sterilized between users).

For these reasons it has been proposed to use safety razors, i.e. razors using a disposable double-edged blade which is so guarded that in the event of careless handling it might nick the patient (or the attendant) but can cause no real injury. However, even these razors are relatively expensive and although the blade can be disposed of after each use, the razor itself must still be sterilized every time. The answer, therefore, appeared to be a disposable razor, of which several types are known. The problem with these, however, is that they are needed in such huge quantities that cost calculations must be extremely stringent and economies in terms of cents or even fractions of cents are very meaningful.

In this connection it has been a problem that heretofore it has not been possible to use single-edged blades in their simplest form, i.e. a strip of metal having a sharp cutting edge with the opposite edge left unworked. To be able to properly mount these blades in the body of the disposable razor it has until now been necessary to embrace the opposite edge with a U-shaped metal channel which is secured to the blade by upsetting, clamping or in similar manner. Given the large number of such razors which are used per annum, the need for this type of blade makes manufacturing economies a decided necessity.

Another problem inherent in the prior-art razors of the kind under discussion, is that the blade guard cannot be removed. Some users, however, prefer to use the razor without a blade guard, partly as a matter of preference and partly because some types of hair—and hair on some parts of the body—cannot be properly shaved off with the blade guard in place. In this respect, also, further improvements are desirable.

SUMMARY OF THE INVENTION

It is, accordingly, a general object of the present invention to overcome the disadvantages of the prior art.

A more particular object is to provide an improved disposable blade-type razor, which can be produced more economically than those known from the prior art.

A concomitant object is to provide a razor of the type under discussion, which can be produced using a single-edge blade the other edge of which is not embraced by the usual channel nor prepared in any other special way.

Yet a further object is to provide such a razor as discussed hereinbefore, which has a blade guard but one that can be easily removed when it is necessary or desired to do so.

Pursuant to these objects, and still others which will become apparent hereafter, one aspect of the invention resides in a disposable razor. Briefly stated, such a razor may comprise a razor body having an upper side and a lower side, a rear portion constituting a handle, and a front portion provided with a slot having an open end adjacent the lower side and extending towards the upper side; a bladeguard extending lengthwise of the slot at the open side and having a comb-shaped edge portion; a razor blade in the slot and having a cutting edge extending out of the open side and located opposite the comb-shaped edge portion; and means for retaining the blade in the slot.

The novel features which are considered as characteristic for the invention are set forth in the appended claims. Both the construction and method of operation of the invention, as well as additional objects and advantages thereof, will however be best understood from the following description of specific embodiments in connection with the accompanying drawings.

DESCRIPTION OF PREFERRED EMBODIMENTS

Figure 1:
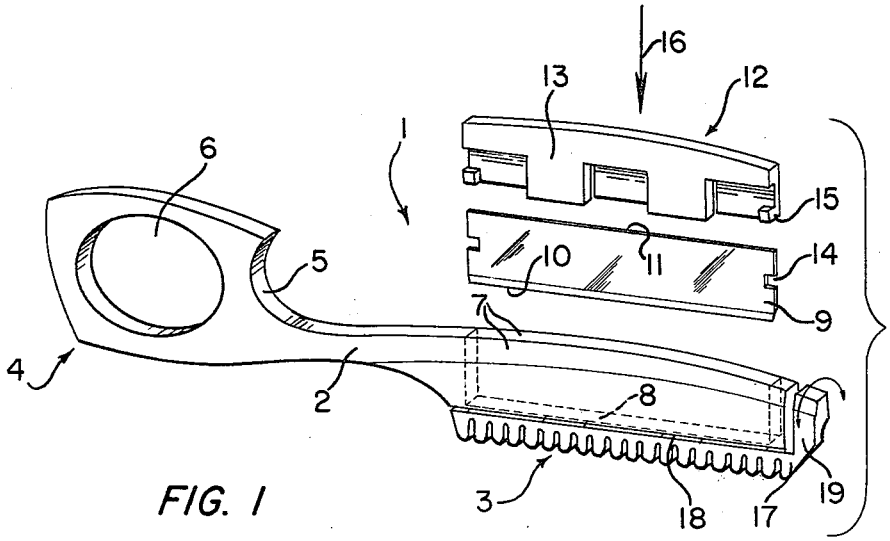
FIG. 1 is an exploded perspective view illustrating one embodiment of the invention.

The disposable razor 1 shown in FIG. 1 has a body 2 with a front portion 3 and a rear portion 4. The rear portion is the handle of the razor and is shaped as an upstanding fin provided with a forwardly facing shoulder or abutment surface 5 and with a hole or opening 6. Proper control (and even swivelling) of the razor is obtained by having one finger of a user's hand inserted into the opening 6 and another finger of the same hand bearing against surface 5.

Front portion 3 of the body 2 is formed with a slot-shaped opening 7 extending from the top (upper) side of body 2 to the bottom (lower) side thereof, adjacent to which the opening 7 has a lower open end 8. A single-edge razor blade 9 is provided, having a cutting edge 10. The other, opposite edge 11 can remain unworked, which is to say that it need not be sharpened nor embraced by the conventional U-shaped channel, since neither of these measures is necessary for reasons already touched upon and which will become still more clear hereafter.

A blade retainer 12 is dimensioned to fit into slot 7 and has lateral bosses 13; the thickness (from front to back) of the retainer 12 is so selected that the blade 9 fits into the slot 7 next to the retainer, i.e. to be confined between and in contact with the bosses 13 and the facing inner surface of slot 7. The ends of blade 9 are provided with notches 14, and projections 15 of the retainer 12 snap into these notches.

The body 2 and the blade retainer 12 are advantageously both made of synthetic plastic material (for example polypropylene, PET, PUT, polystyrene) and can be made quickly and inexpensively by injection molding using known-per-se techniques. To assemble the razor (i.e. to obtain the finished, ready-to-use product) the blade 7 and retainer 12 are connected by engagement of portions 14, 15 and inserted into the slot 7 as indicated by arrow 16; the retainer 12 is then connected to body 2 by means of adhesive, hot fusing (e.g. RF welding), sonic welding or in any known-per-se manner.

During manufacture of the body 2 the portion 3 is formed with an integral blade guard 17 having the usual teeth and spaces therebetween. The strip-shaped blade guard is of one piece with the portion 3 only at the locations 18; everywhere else it is separated from the portion 3 (e.g. being separated therefrom by a narrow gap, as shown). A portion 19 of the blade guard extends upwardly in front of the forward end of portion 3, as shown. In normal use the cutting edge 10 of the blade 9 will extend beyond open slot end 8, out of the portion 3 and to the free edge of the teeth of the blade guard 17. If, however, the user prefers (or needs) to work without the blade guard, he simply grips the body 2 with one hand and the portion 19 with the other, and twists the two relative to each other as indicated by the arrow. This causes blade guard 17 to snap off at the portions 18 so that the entire lower margin of the blade 9 with the edge 10, is now exposed for use.

Figure 2:
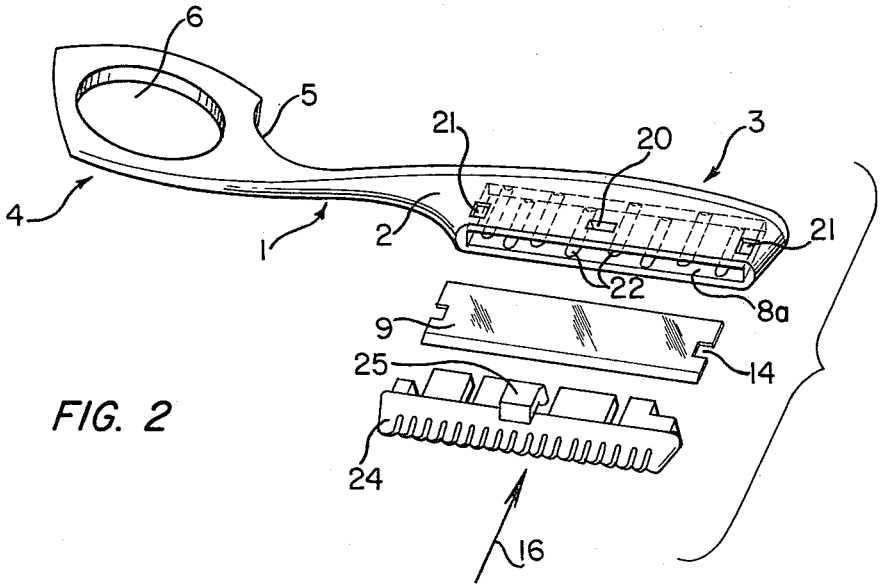
FIG. 2 is a view analogous to FIG. 1 but illustrating another embodiment of the invention.

In the embodiment of FIG. 2 like reference numerals identify like elements as in FIG. 1.

Unlike FIG. 1, however, the portion 3 of the razor 1 of FIG. 2 is formed with a slot 8*a* which is open only at the bottom side of the razor, not at the top. The outer sides of both side walls (only one shown) bounding the slot 8*a* are formed with depressions 20 (one shown) and at least one of the side walls has two openings or recesses 21. The inner surfaces bounding the slot 8*a* are formed with projecting ribs 22. Again, the razor body 2 as well as the still to be described blade guard 24 can be made from synthetic plastic material by injection molding.

Blade 10 with notches 14 is the same as in FIG. 1. The blade guard 24, however, is a separate element, dimensioned to fit into the slot 8*a*. One lateral side of the guard 24 is provided with a hook-formation 25 which snaps into recess 20 at the exterior of portion 3 when the guard is inserted into slot 8*a*. Since portion 3 is provided with depressions 20 at both sides, the guard can be installed in either orientation, i.e. with the top of the hook formation pointing inwardly of the plane of the drawing (away from the viewer) or outwardly thereof (towards the viewer). The blade 9 is accomodated in slot 8*a* in the space between either of the inner slot surfaces and the guard 24; it is maintained centered by the ribs 22 and is secured to the body 2 by adhesive or melted hardenable synthetic plastic admitted into the openings 21 and notches 14 to fill the same. When the blade guard 24 is not wanted, the formation 25 is simply dislodged from the depression 20 and the guard pulled off. If openings 21 are replaced by depressions, securing of the blade is performed by hot deformation of existing plastic into notches 14.

It will be understood that the invention as herein disclosed by way of two exemplary embodiments, is susceptible of various modifications all of which are intended to be embraced within the scope of the appended claims. Furthermore, the razor according to the invention need not be used merely for surgical preparation, but can also find other applications, for example for hair styling or for ordinary shaving of facial hair. The blade can be a standard double-edged blade, if desired, but of course only one of the cutting edges will be used.

The invention as described hereinbefore is merely representative of the various modifications; the actual scope of protection sought is defined exclusively in the appended claims.

I claim:

1. A disposable razor, comprising a razor body, having an upper side and a lower side, a rear portion constituting a handle and a front portion provided with a slot having an open end adjacent said lower side and extending towards said upper side;

a bladeguard extending lengthwise of said slot at said open side and having a comb-shaped edge portion;

a razor blade in said slot and having a cutting edge extending out of said open side and located opposite said comb-shaped edge portion; and means for retaining said blade in said slot, said bladeguard being connected to said body at spaced locations by break-way portions and including a gripping portion engageable by the fingers of a user so as to effect relative twisting of said bladeguard and body and cause said break-way portions to break with resultant detaching of the bladeguard from the body.

2. A razor as defined in claim 1, said slot having another open end at said upper side; and further comprising a blade retainer received in said slot through said other open end and lodges in said slot between said blade and a portion of the surface bounding the interior of said slot.

3. A razor as defined in claim 2, said means comprising cooperating engaging portions on said blade and retainer and operative for engaging one another with a snap action.

4. A razor as defined in claim 2, at least one of said body, bladeguard and retainer being of synthetic plastic material.

5. A razor as defined in claim 1, said body and bladeguard being of synthetic plastic material.

6. A razor as defined in claim 1, said body and bladeguard being of one piece with one another.

7. A razor as defined in claim 1, said rear portion including an upstanding fin formed with a hole and with an edge facing toward said front portion and formed with a finger-contact edge.

8. A razor as defined in claim 1, said body and bladeguard being unitary with one another.

* * * * *